US007575646B2

(12) United States Patent
Hashimura et al.

(10) Patent No.: US 7,575,646 B2
(45) **Date of Patent: *Aug. 18, 2009**

(54) HEAT-TREATED STEEL WIRE FOR HIGH STRENGTH SPRING

(75) Inventors: Masayuki Hashimura, Muroran (JP); Takanari Miyaki, Muroran (JP); Hiroshi Hagiwara, Chiyoda-ku (JP); Hiroaki Hayashi, Chiyoda-ku (JP); Shouich Suzuki, Chiyoda-ku (JP); Katsuaki Shiiki, Wako (JP); Noriyuki Yamada, Wako (JP); Seiichi Koike, Wako (JP)

(73) Assignee: Nippon Steel Corporation, Tokyo (JP)

( * ) Notice: Subject to any disclaimer, the term of this patent is extended or adjusted under 35 U.S.C. 154(b) by 687 days.

This patent is subject to a terminal disclaimer.

(21) Appl. No.: 10/467,493

(22) PCT Filed: Feb. 7, 2002

(86) PCT No.: PCT/JP02/01049

§ 371 (c)(1),
(2), (4) Date: Jan. 22, 2004

(87) PCT Pub. No.: WO02/063055

PCT Pub. Date: Aug. 15, 2002

(65) Prior Publication Data

US 2004/0112473 A1 Jun. 17, 2004

(30) Foreign Application Priority Data

Feb. 7, 2001 (JP) ..... 2001-030511

(51) Int. Cl.
*C22C 38/22* (2006.01)

(52) U.S. Cl. ..... 148/333; 420/114

(58) Field of Classification Search ..... 148/908, 148/333, 334

See application file for complete search history.

(56) References Cited

U.S. PATENT DOCUMENTS 5,897,717 A 4/1999 Hashimura et al.

FOREIGN PATENT DOCUMENTS

| | | | |
|---|---|---|---|
| DE | 19947993 | | 1/2002 |
| EP | 0943697 | | 9/1999 |
| EP | 1347069 | | 9/2003 |
| JP | 63128152 | | 5/1988 |
| JP | 63227748 | | 9/1988 |
| JP | 05331597 | | 12/1993 |
| JP | 405331597 | * | 12/1993 |
| JP | 406240408 | * | 8/1994 |
| JP | 10330840 | | 12/1998 |
| JP | 116033 | | 1/1999 |
| JP | 411006033 | * | 1/1999 |
| JP | 11315349 | | 11/1999 |
| JP | 2002-219938 | * | 8/2000 |

OTHER PUBLICATIONS

English Translation of Murai (JP 05-331597).*
English Translation of Yamao et al. (JP 11-006033).*
English Translation of Hirai et al. (JP 06-240408).*
English Translation of Nishida et al. (JP 2000-219938).*

* cited by examiner

*Primary Examiner*—Roy King
*Assistant Examiner*—Jessee R. Roe
(74) *Attorney, Agent, or Firm*—Baker Botts LLP

(57) ABSTRACT

The present invention provides a steel wire, for springs excellent in coiling property while having a high strength, as a heat treated steel wire for high strength springs, characterized by: comprising, in mass, C: 0.75 to 0.85%, Si: 1.5 to 2.5%, Mn: 0.5 to 1.0%, Cr: 0.3 to 1.0%, P: not more than 0.015%, S: not more than 0.015%, N: 0.001 to 0.007%, W: 0.05 to 0.3%, and the balance consisting of Fe and unavoidable impurities; having a tensile strength of not less than 2,000 MPa; spheroidal carbides, composed of mainly cementite, observed in a microscopic visual field satisfying the area percentage of the spheroidal carbides not less than 0.2 μm in circle equivalent diameter being not more than 7%, the density of the spheroidal carbides 0.2 to 3 μm in circle equivalent diameter being not more than 1 piece/$\mu m^2$, and the density of the spheroidal carbides over 3 μm in circle equivalent diameter being not more than 0.001 piece/$\mu m^2$; the prior austenite grain size number being #10 or larger; the content of the retained austenite being not more than 12 mass %; the maximum diameter of carbides being not more than 15 μm; and the maximum diameter of oxides being not more than 15 μm.

2 Claims, 3 Drawing Sheets

HEAT-TREATED STEEL WIRE FOR HIGH STRENGTH SPRING

CROSS-REFERENCE TO RELATED APPLICATIONS

This application is a national stage application of PCT Application No. PCT/JP02/01049 which was filed on Feb. 7, 2002 and published on Aug. 5, 2002as International Publication No. WO02/063055 (the "International Application"), the entire disclosure of which is incorporated herein by reference. This application claims priority from the International Application pursuant to 35 U.S.C. §365. The present application also claims priority under 35 U.S.C. § 119 from Japanese Patent Application No. 2001-030511, filed on Feb. 7, 2001, the entire disclosure of which is incorporated herein by reference.

FIELD OF THE INVENTION

The present invention relates to a steel wire for springs, which is cold-coiled and has high strength and high toughness.

BACKGROUND INFORMATION

Due to the trends toward weight reduction high performance of automobiles, springs have been strengthened and a high-strength steel having a tensile strength exceeding 1,500 MPa, after heat treatment, has been applied to springs. In recent years, a steel wire having a tensile strength exceeding 1,900 MPa has also been required. The purpose is to secure a material hardness which does not cause problems when the material is used as a spring even though the material softens to some extent by heating in stress relief annealing, nitriding and the like when manufacturing a spring.

As a means to secure such a material, Japanese Unexamined Patent Publication No. S57-32353 discloses a method of generating fine carbides, which dissolve during quenching and precipitate during tempering, by adding elements such as V, Nb, Mo, etc., and by so doing, controlling the movement of dislocations and thus improving setting resistance.

In the meantime, as methods to produce a steel coil spring, there are the hot-coiling method wherein a steel is heated to a temperature in an austenite region, coiled, and then quenched and tempered, and the cold-coiling method wherein a high-strength steel wire prepared by subjecting a steel to quenching and tempering beforehand is coiled in a cold state. In the cold-coiling method, since oil tempering treatment, high-frequency treatment or the like capable of employing rapid heating and rapid cooling when producing a steel wire can be used, it is possible to reduce the prior austenite grain size of a spring material and, as a result, a spring excellent in fracture property can be produced. Further, the method has an advantage of reducing the equipment cost for a spring maker since an installation such as a heating furnace in a spring manufacturing line can be simplified, and therefore a shift to the cold-coiling of a spring has advanced in recent years.

However, when the strength of a steel wire for a cold-coiled spring increases, it happens frequently that the steel wire breaks during the cold-coiling and cannot be formed into the shape of a spring. Therefore, there has been no other way than to coil a steel wire by a method which cannot provide strength and workability simultaneously and seems to be industrially disadvantageous. Usually, in the case of a valve spring, a steel wire after being subjected to quenching and tempering, namely oil tempering, on-line. is coiled. For example, in Japanese Unexamined Patent Publication No. H05-179348, a wire is heated and coiled at a temperature where the wire is easily transformed during coiling to prevent breakage during the coiling in such a manner that a wire is heated to a temperature of 900 to 1,050° C. and coiled, and after that is tempered at a temperature of 425 to 550° C., and thereafter the wire is subjected to conditioning treatment after the coiling to secure high strength. Such heating during coiling and conditioning after the coiling cause the dispersion of spring dimensions after heat treatment or the radical deterioration of treatment efficiency, and therefore a spring produced by this method is inferior to a cold-coiled spring in both the cost and the dimensional accuracy.

With regard to the grain size of carbides, an invention developed by noticing the average grain size of V or Nb system carbides is disclosed in Japanese Unexamined Patent Publication No. H10-251804, for example, and the invention shows that with only the control of the average grain size of V or Nb carbides, sufficient strength and toughness cannot be obtained. Moreover, in this prior art, it is stated that there is a concern that an abnormal structure appears, which is caused by cooling water during rolling, and, therefore, it is recommended to substantially employ dry rolling. From this description, it is assumed that the art involves unsteady work industrially and is apparently different from usual rolling, and it suggests that even though the average grain size is controlled, troubles in rolling occur when the unevenness of a nearby matrix structure is generated.

SUMMARY OF THE INVENTION

The object of the present invention is to provide a steel wire, for springs having a tensile strength of not less than 2,000 MPa, which is coiled in a cold state and can secure both the sufficient strength in the atmosphere and workability in the coiling, simultaneously.

The present inventors found that a steel wire for springs, which can secure both the high strength and the coiling property simultaneously, can be obtained by controlling the size of carbides, particularly cementites, in steel, which had not been noticed in a conventional steel wire for springs.

The gist of the present invention is as follows:

(1) A heat treated steel wire for high strength springs, characterized by:

comprising, in mass,

C: 0.75 to 0.85%,

Si: 1.5 to 2.5%,

Mn: 0.5 to 1.0%,

Cr: 0.3 to 1.0%,

P: not more than 0.015%,

S; not more than 0.015%,

N: 0.001 to 0.007%,

W: 0.05 to 0.3%, and the balance consisting of Fe and unavoidable impurities;

having a tensile strength of not less than 2,000 MPa;

spheroidal carbides composed of mainly cementite, observed in a microscopic visual field satisfying the ratio of the area occupied by the spheroidal carbides not less than 0.2 μmin circle equivalent diameter being not more than 7%, the density of the spheroidal carbides 0.2 to 3 μm in circle equivalent diameter being not more than 1 piece/$\mu m^2$, and the density of the spheroidal carbides over 3 μmin circle equivalent diameter being not more than 0.001 piece/$\mu m^2$;

the prior austenite grain size number being #10 or larger;

the content of the retained austenite being not more than 12 mass %;

the maximum diameter of carbides being not more than 15 μm; and the maximum diameter of oxides being not more than 15 μm.

(2) A heat treated steel wire for high strength springs according to the item (1), characterized by further containing, in mass, one or two of Mo: 0.05 to 0.2% and V: 0.05 to 0.2%.

All referred-to references are incorporated herein by reference in their entireties.

BRIEF DESCRIPTION OF THE DRAWINGS

FIG. 3(*b*) is a schematic drawing showing the outline of the notch bending test method after loading.

DETAILED DESCRIPTION

Figure 1:
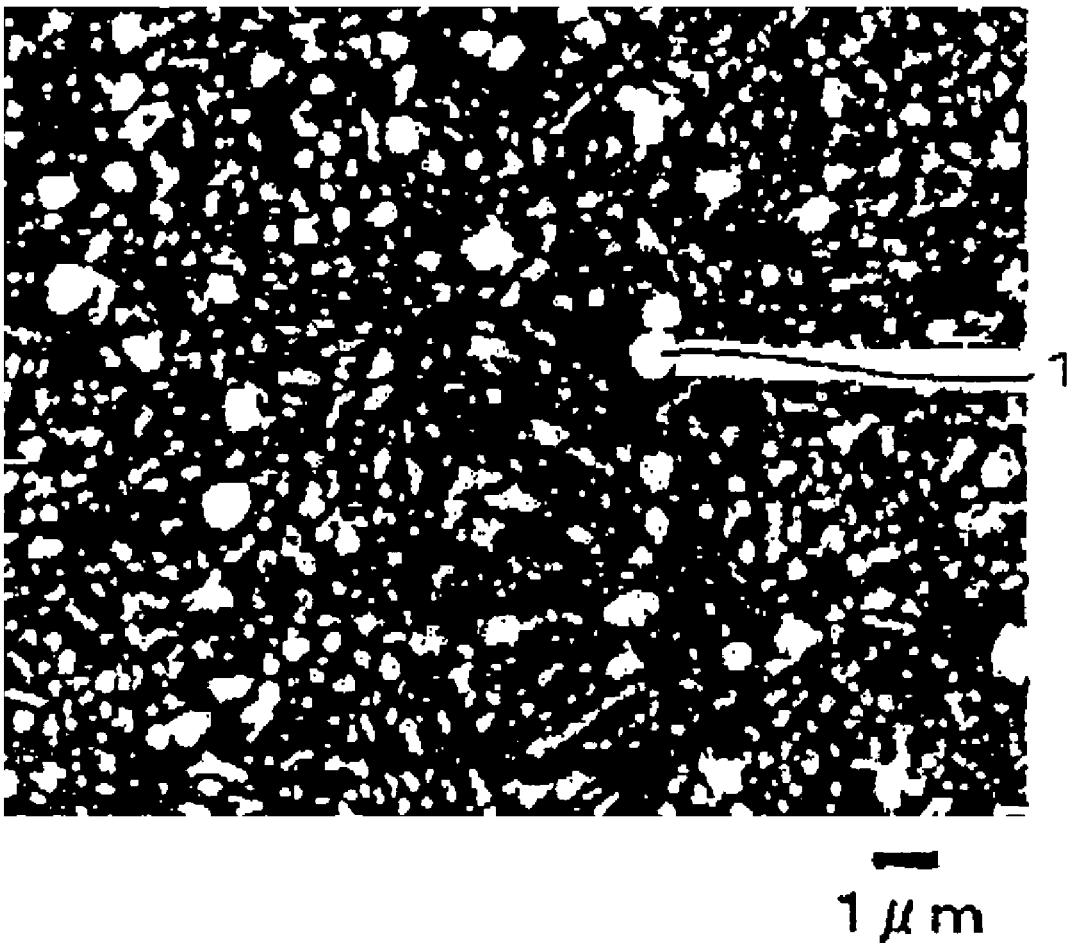
FIG. 1 is a photomicrograph showing the quenched and tempered structure of a steel.

A steel wire capable of securing a coiling property sufficient for manufacturing springs by controlling the shape of carbides in steel with a heat treatment, according to the present invention is provided, while regulating the chemical composition to obtain a high strength. The details are provided herein below.

Firstly, the reasons for prescribing the chemical composition of steel will be explained.

C is an element which greatly affects the basic strength of a steel material, and is set at 0.75 to 0.85% so as to secure more strength than a conventional one. If less than 0.75%, a sufficient strength cannot be obtained. 0.75% or more of C is required for securing sufficient spring strength even when nitriding for spring performance improvement is excluded, in particular. If C exceeds 0.85%, hyper-eutectoid appears and coarse cementites precipitate in a large amount, and therefore the toughness is deteriorated markedly. At the same time, this deteriorates the coiling property too.

Si is an element necessary for securing sufficient strength, hardness and setting resistance of a spring. If the amount is small, the strength and setting resistance are insufficient and therefore the lower limit is set at 1.5%. Also, Si has the effect of spheroidizing and fining carbide precipitates at grain boundaries, and by actively adding it, there arises the effect of decreasing the ratio of the area occupied by grain boundary precipitates in the grain boundaries. However, if Si is added excessively, the material not only hardens but also embrittles. Therefore, the upper limit is set at 2.5% for preventing the embrittlement after quenching and tempering.

The lower limit of Mn is set at 0.5% for securing sufficient hardness and suppressing strength degradation by fixing S existing in steel as MnS. On the other hand, the upper limit is set at 1.0% for preventing the embrittlement caused by Mn.

N hardens a steel matrix and, when an alloying element such as Ti or V, etc. is added, it exists as nitrides and affects the property of a steel wire. In a steel to which Ti, Nb, or V, etc. is added, carbonitrides are easily generated and N is apt to form the sites where carbides, nitrides and carbonitrides which act as pinning particles for fining austenite grains are precipitated. Thus, it is possible to stably generate pinning particles under various heat treatment conditions employed during the production processes of springs and to control the austenite grain size in a steel wire finely. For that purpose, 0.001% or more of N is added. On the other hand, N in excessive amount causes the coarsening of nitrides and carbonitrides formed by the nitrides acting as nuclei and carbides. For example, when Ti is added, coarse TiN precipitates, or when B is added, BN precipitates, and they cause deterioration of fracture property. For those reasons, the upper limit of N is set at 0.007% which does not cause problems.

P hardens a steel, and moreover generates segregation and thus embrittles a material. In particular, P segregating at austenite grain boundaries causes the deterioration of an impact value and delayed fracture caused by the intrusion of hydrogen. Therefore, the small amount of P is preferable. For those reasons, P is restricted to not more than 0.015% beyond which the embrittlement becomes remarkable. S also embrittles a steel, as P does, when it exists in the steel. Though the adverse effect can be alleviated by adding Mn, since MnS itself takes the form of inclusions, the fracture property deteriorates. in the case of a high-strength steel in particular, fracture occurs sometimes caused by a very small amount of MnS and therefore it is desirable to make the S amount small. The upper limit of S is set at 0.015% beyond which the adverse effect becomes remarkable.

Cr is an element effective for improving quenching property and softening resistance in tempering. However, if the addition amount is large, Cr not only increases the cost but also coarsens cementites which appear after quenching and tempering. As a result, a wire becomes brittle and thus breakage during coiling tends to occur. Therefore, the lower limit is set at 0.3% for securing a good quenching property and a good softening resistance in tempering, and the upper limit is set at 1.0% beyond which the embrittlement becomes remarkable. In particular, when the amount of C is not less than 0.75% which is close to the range of eutectoid formation, it is better to suppress the amount of Cr for suppressing the formation of coarse carbides and for securing both good strength and good coiling property simultaneously. On the other hand, when a nitriding treatment is employed, it is better to add Cr to make the hardened layer formed by the nitriding deep. From the above, Cr is determined to be in the range of 0.3 to 1.0%.

W improves a quenching property and, at the same time, generates carbides in a steel, and has the function to enhance strength. Therefore, it is preferable to add W as much as possible. The specific feature of W is, different from other elements, to fine the shape of carbides including cementites. If the addition amount is less than 0.05%, the effect does not appear, but if the same exceeds 0.3%, coarse carbides are generated and there arises a concern of deteriorating mechanical properties such as ductility. For those reasons, the addition amount of W is set to be in the range of 0.05 to 0.3%.

Mo and V precipitate as nitrides, carbides and carbonitrides in a steel. Therefore, by adding one or two of these elements, it is possible to form those precipitates, obtain softening resistance in tempering, and thus demonstrate high strength without causing softening even after a heat treatment such as a tempering at a high temperature, a stress relief annealing applied during processing, a nitriding and the like. This enables the deterioration of the hardness inside a spring after the nitriding to be suppressed, and the hot setting and the stress relief annealing to be implemented easily, and therefore the fatigue property of the spring to improve as a whole. However, if the addition amount of Mo and v is too large, those precipitates grow too big, connect with carbon in a steel, and generate coarse carbides. This causes the amount of C which should contribute to the high-strengthening of a steel wire to decrease and a strength equivalent to the amount of added C is not obtained. Moreover, since the coarse carbides become the source of stress concentration, a steel wire tends to break due to the deformation during coiling.

Mo can improve quenching property and secure softening resistance in tempering by adding it at the percentage of 0.05 to 0.2. By so doing, it is possible to raise the tempering temperature when controlling strength. This is advantageous in decreasing the ratio of grain boundary area occupied by grain boundary carbides. In other words, this is effective for spheroidizing the grain boundary carbides precipitating in the form of films by tempering them at a high temperature, and thus decreasing the area ratio thereof in the grain boundaries. Further, Mo generates, besides cementites, Mo system carbides in a steel. In particular, since Mo has a low precipitation temperature compared with V, etc., Mo shows the effect of suppressing the coarsening of carbides. The effect is not recognized when the addition amount is less than 0.05%. However, if the addition amount is large, a supercooling structure tends to be generated during rolling, softening heat treatment before drawing, or the like, and that is apt to cause cracks and wire breakage during drawing. Therefore, when carrying out drawing, it is preferable to draw a steel material after forming a ferrite-pearlite structure in the steel material by a patenting treatment beforehand. However, when Mo exceeds 0.2%, the time up to the end of pearlite transformation becomes long, the pearlite transformation cannot be terminated by a conventional patenting apparatus, and that causes martensites to generate at the portions of micro-segregation which is unavoidably formed in a steel material. The martensites cause wire breakage during drawing, or when they do not cause wire breakage and exist as internal cracks, they markedly deteriorate the properties of the final product. For these reasons, the upper limit is set at 0.2% wherein the generation of a martensite structure is suppressed and rolling and drawing can be carried out easily and industrially stably.

With regard to V, it can be utilized for the hardening of a steel wire at a tempering temperature or the hardening of a surface layer during nitriding, in addition to the suppressing of the coarsening of an austenite grain size which is caused by the generation of nitrides, carbides and carbonitrides. When the addition amount is less than 0.05%, the effect of the addition is hardly recognized. On the other hand, the addition in a large amount causes coarse insoluble inclusions to be generated and toughness to deteriorate, and, at the same time, like Mo, a supercooling structure tends to be generated and that is apt to cause cracks and wire breakage during drawing. For those reasons, the upper limit is set at 0.2% wherein an industrially stable operation can be carried out easily. The prescription of the carbides will be explained hereunder. To obtain both strength and workability simultaneously, the configuration of carbides in a steel is important. Here, the carbides in a steel means: the cementites generated after heat treatment and the carbides formed by dissolving alloying elements therein (both are hereunder referred to as "cementites" in general); and the carbides and carbonitrides of alloying elements such as Nb, V, Ti, etc. Those carbides can be observed by specularly polishing and etching a steel wire.

A typical example of the observation is shown in FIG. 1. According to the photomicrograph, observed are the two kinds of carbides, acicular and spheroidal ones. In general, it is known that a steel forms acicular structures composed of martensites by quenching and generates carbides by tempering, and, by so doing, both strength and toughness can be obtained simultaneously. However, the present inventors noticed that not only acicular structures but also spheroidal carbides 1 remained in a great quantity as shown in FIG. 1, and found that the distribution of the spheroidal carbides greatly affected the properties of a steel wire for springs. It is estimated that the spheroidal carbides are carbides which are not sufficiently dissolved by the quenching and tempering in an oil-tempering treatment or a high frequency treatment and are spheroidized and grow or shrink in the quenching and tempering processes. The carbides of this size do not contribute at all to the improvement of strength and toughness by quenching and tempering. Based on that, the present inventors found that the spheroidal carbides not only wasted the added C by fixing C in a steel but also acted as the source of stress concentration, and thus became a factor in deteriorating the mechanical properties of a steel wire.

In the case of cold-coiling a steel after quenching and tempering the steel as seen in this material, carbides affect the coiling property, namely the bending property until breakage occurs. Though it has been generally adopted up to now to add in a great quantity not only C but also alloying elements such as Cr, V, etc. for obtaining strength, there have been drawbacks of too high a strength, insufficient deformation capability and a deteriorated coiling property. It is estimated that the drawbacks are caused by the coarse carbides precipitating in a steel.

Figure 2A:
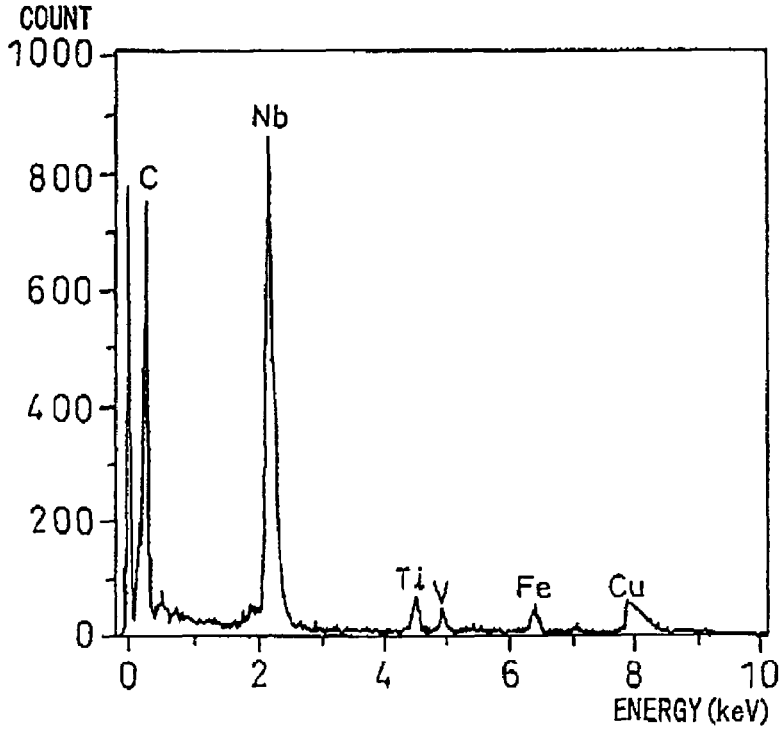
FIG. 2 consists of the graphs showing the examples of analyzing spheroidal carbides, (a) showing the example of analyzing alloy system spheroidal carbides and (b) the same of analyzing spheroidal carbides composed of mainly cementite.
Figure 2B:
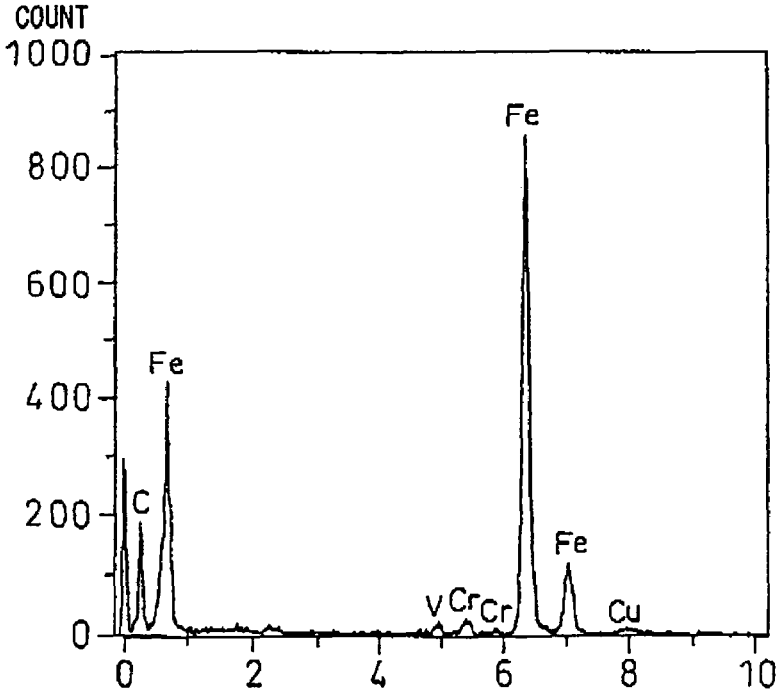

Examples of the analysis using an energy dispersion X-ray analyzer (EDX) attached to a scanning electron microscope (SEM) are shown in (a) and (b) of FIG. 2. Analysis results similar to those results are also obtained by the replica method using a transmission electron microscope. Conventional inventions pay attention to only the carbides of alloying elements such as V, Nb, etc. and an example thereof is shown in FIG. 2(*a*), which is characterized in that the peak of Fe in the carbides is extremely small. On the other hand, in the present invention, it was found that, not only the conventional alloying element carbides but also the configuration of the precipitation of what is called carbides, composed of mainly cementite, which were composed of $Fe_3C$ 3 μm or less in circle equivalent diameter and alloying elements scarcely dissolved therein as shown in FIG. 2(*b*), is important. In the case of attaining simultaneously both high strength and workability more excellent than those of conventional steel wires, as in the case of the present invention, if the spheroidal carbides, composed of mainly cementite, 3 μm or less in circle equivalent diameter are abundant, the workability is markedly deteriorated. Hereafter, the spheroidal carbides mainly composed of Fe and C as shown in FIG. 2(*b*) are referred to as "carbides composed of mainly cementite."

Those carbides in a steel can be observed by applying an etching solution such as picral to a test piece specularly polished. However, in order to observe and evaluate their dimensions and the like further in detail, it is necessary to observe them at a high magnification over 3,000 times using a scanning electron microscope. The size of the spheroidal carbides, composed of mainly cementite, discussed here is 0.2 to 3 μm in circle equivalent diameter. Usually, carbides in a steel is essential for securing the strength and softening resistance in the tempering of the steel, but the effective grain size is not more than 0.1 μm, and if it exceeds 1 μm, on the contrary, the carbides do not rather contribute to the fining of an austenite grain size and merely deteriorate the deformation property. However, in the prior art, the importance was not well recognized, only the carbides of the system containing the alloying elements such as V, Nb, etc. were noticed, the carbides 3 μm or less in circle equivalent diameter, spheroidal carbides composed of mainly cementite in particular, were regarded to be harmless, and therefore an instance wherein the carbides having a size of about 0.1 to 5 μm, which are the major objects of the present invention, were studied cannot be found.

Further, in the case of the spheroidal carbides composed of mainly cementite 3 μm or less in circle equivalent diameter which are the objects of the present invention, not only the size but also the number is a large factor. Therefore, the scope of the present invention is prescribed taking both factors into consideration. That is, even though the circle equivalent diameter is small in the range of 0.2 to 3 μm in average diameter, when the number is very large and the density in a microscopic visual field exceeds 1 piece/$\mu m^2$, then the coiling property remarkably deteriorates and therefore the upper limit is set at 1 piece/$\mu m^2$.

Further, if the size of the carbides exceeds 3 μm, the influence of the size becomes further remarkable, and in that situation, if the density in a microscopic visual field exceeds 0.001 piece/$\mu m^2$, then the coiling property remarkably deteriorates. Therefore the upper limit of the density of the carbides over 3 μm in circle equivalent diameter in a microscopic visual field is set at 0.001 piece/$\mu m^2$, and the range in the present invention is set at not more than that value.

Further, disregarding the size of the spheroidal carbides composed of mainly cementite, if the area percentage of the spheroidal carbides in a microscopic visual field exceeds 7%, then the coiling property remarkably deteriorates and coiling operation becomes impossible. Therefore, the area percentage thereof in a microscopic visual field is set at not more than 7%.

However, a prior austenite grain size, similar to a carbide grain size, exerts a great influence on the fundamental properties of a steel wire. More specifically, the smaller the prior austenite grain size is, the more excellent the fatigue property and coiling property are. However, however small the prior austenite grain size may be, the effect is small if the above-mentioned carbides are abundantly contained and exceed the prescription. It is effective in general to lower a heating temperature to reduce the austenite grain size, but, on the contrary, this causes the above-mentioned carbides to increase. Therefore, it is important to finish a steel wire so that the carbide amount and the prior austenite grain size are appropriately balanced. In this connection, on the premise that the carbides satisfy the above prescription, the prior austenite grain size number is prescribed to be not less than #10, because, if the prior austenite grain size number is less than #10, sufficient fatigue property cannot be obtained.

Retained austenites tend to remain in the vicinity of segregated portions and prior austenite grain boundaries. It was found that, though the retained austenites transformed into martensites by work induced transformation, if the induced transformation occurred during spring forming, highly hardened portions were locally generated in the material and the coiling property of a spring was rather deteriorated. Recently, springs have been subjected to surface strengthening by applying plastic deformation such as shot peening or setting and, in the case where manufacturing processes including plural processes wherein such plastic deformation is applied, are employed, the work induced martensites generated in an early stage lower the fracture strain and deteriorate the workability and fracture property of springs in service. Further, in the case where industrially unavoidable deformations such as dents and the like are present, a steel wire easily breaks during coiling. Therefore, the workability is improved by reducing retained austenites to the utmost and suppressing the generation of work induced martensites. Concretely, if the amount of retained austenites exceeds 12% (in weight), the susceptibility to dents and the like increases and breakage easily occurs during coiling and other operations. Therefore, the amount of retained austenites is set at not more than 12%.

In particular, in the case where the amount of C is not more than 0.75% as the case of the present invention, if the martensite generating temperature (start temperature: Ms point, finish temperature: Mf point) becomes low, martensites are not generated and retained austenites are apt to remain unless the temperature during quenching is lowered sufficiently. Water or oil is used for quenching industrially, but a sophisticated heat treatment control is required for suppressing retained austenites. More specifically, required is an appropriate control such as to keep the temperature of a coolant low, to keep the temperature low to the utmost even after the cooling, to keep the time of transformation to martensites long, or the like. Though the temperature of a coolant easily rises close to 100° C. industrially, as the treatments are carried out in a continuous line, it is preferable to keep the temperature thereof to not more than 60° C.

Further, when both the maximum grain size of all carbides including alloying element carbides and the like and the maximum grain size of oxides exceed 15 μm, that causes the fatigue property to deteriorate. Therefore, the upper limits of the maximum grain sizes thereof are set at 15 μm, respectively.

In general, a steel for springs is, after being continuously cast, rolled into billets, rolled into wire rods and then drawn into wires, and after that, in the case of cold-coiled springs, the drawn wires are given strength by applying an oil temper treatment or a high frequency treatment. For suppressing the spheroidal carbides composed of mainly cementite, it is necessary to pay attention not only to the final heat treatment such as an oil temper treatment, a high frequency treatment or the like, which determines the strength of a steel wire, but also to the rolling processes which precede the drawing process. In other words, as it is considered that the spheroidal carbides composed of mainly cementite grow with cementites and alloyed carbides insoluble during the rolling processes and the like acting as nuclei, it is important to fully dissolve the components during each heating process in rolling. In the present invention, it is important to heat a steel material to a sufficiently high temperature, even in the rolling processes, then roll it, and draw it.

EXAMPLE

Table 1 shows, in the case of the steel wires 4 mm in diameter and with regard to Invented Examples and Comparative Examples: chemical compositions; the ratios of the areas occupied by spheroidal carbides composed of mainly cementite 0.2 μm or more in circle equivalent diameter; the densities of spheroidal carbides composed of mainly cementite 0.2 to 3 μm in circle equivalent diameter; the densities of spheroidal carbides composed of mainly cementite over 3 μm in circle equivalent diameter; the maximum diameters of carbides and oxides; prior austenite grain size numbers; the amounts of retained austenites (in weight %); tensile strength; coiling property (in terms of notch bending angle); and average fatigue strength.

In Invented Example 1 according to the present is invention, a billet was produced by continuously casting steel refined with a 250 ton converter. In the other Invented Examples and all Comparative Examples, billets were produced by rolling after steel was melted and refined with a 2 ton vacuum melting furnace. In those cases, Invented Examples were retained at a high temperature of not less than 1,200° C. for a prescribed period of time. After that, in all cases, the billets were rolled into wire rods 8 mm in diameter, and then steel wires 4 mm in diameter were prepared by drawing. In the case of Comparative Examples, the billets were rolled under the usual conditions and drawn.

Since the amount of carbides and strength vary depending on the chemical compositions, in the Invented Examples, the materials were heat-treated in conformity with the chemical compositions so as to secure the tensile strength of about 2,100 MPa and satisfy the prescriptions shown in the claims. On the other hand, in Comparative Examples, the materials were heat-treated merely so as to equalize the tensile strength.

In the quenching and tempering treatment (oil tempering treatment), the drawn materials were passed through a heating furnace continuously and the time required for passing through the heating furnace was determined so that the interior of the steel was sufficiently heated. In both Invented Examples and Comparative Examples, heating temperature was set at 950° C., heating time at 150 sec., and quenching temperature at 50° C. (in an oil tank). After that, the materials were tempered at a tempering temperature of 400 to 500° C. for 1 min. of tempering time, and the strength was adjusted. The resultant tensile strength in the atmosphere is listed in Table 1.

TABLE 1

| Example | No. | Chemical compositions C | Si | Mn | P | S | Cr | W | V | Mo | N | Area percentage % | Density 0.2–3 | >3 | Maximum diameter of carbide μm | Maximum diameter of oxide μm | Prior austenite grain size number | Retained austenite % | Tensile strength MPa | Bending angle in notch-bending | Fatigue strength in rotating bending fatigue MPa |
|---|---|---|---|---|---|---|---|---|---|---|---|---|---|---|---|---|---|---|---|---|---|
| Inventive Steel | 1 | 0.84 | 1.97 | 0.92 | 0.008 | 0.007 | 0.47 | 0.22 | | | 0.0045 | 2.5 | 0.15 | <0.0001 | 12.2 | 11.0 | 12 | 8.0 | 2097 | 36 | 867 |
| Inventive Steel | 2 | 0.79 | 1.74 | 0.97 | 0.008 | 0.011 | 0.35 | 0.19 | | | 0.0054 | 0.6 | 0.03 | <0.0001 | 10.6 | 11.4 | 13 | 7.1 | 2106 | 38 | 854 |
| Inventive Steel | 3 | 0.77 | 1.84 | 0.84 | 0.010 | 0.003 | 0.50 | 0.13 | | | 0.0051 | 0.5 | 0.21 | <0.0001 | 10.5 | 10.9 | 11 | 9.7 | 2093 | 38 | 855 |
| Inventive Steel | 4 | 0.79 | 1.70 | 0.91 | 0.006 | 0.006 | 0.38 | 0.09 | 0.11 | | 0.0051 | 1.5 | 0.09 | <0.0001 | 12.4 | 11.5 | 11 | 10.9 | 2074 | 36 | 857 |
| Inventive Steel | 5 | 0.83 | 1.71 | 0.66 | 0.003 | 0.006 | 0.31 | 0.27 | | 0.17 | 0.0021 | 1.7 | 0.27 | <0.0001 | 11.1 | 11.4 | 10 | 11.5 | 2176 | 33 | 888 |
| Inventive Steel | 6 | 0.75 | 1.91 | 0.56 | 0.010 | 0.005 | 0.34 | 0.19 | 0.21 | | 0.0034 | 1.5 | 0.23 | <0.0001 | 10.1 | 10.0 | 11 | 10.3 | 2089 | 39 | 855 |
| Inventive Steel | 7 | 0.81 | 1.91 | 0.91 | 0.009 | 0.008 | 0.35 | 0.14 | 0.16 | 0.20 | 0.0038 | 1.9 | 0.31 | <0.0001 | 12.9 | 11.4 | 12 | 8.6 | 2141 | 33 | 869 |
| Inventive Steel | 8 | 0.80 | 2.00 | 0.88 | 0.005 | 0.007 | 0.37 | 0.06 | | | 0.0053 | 1.2 | 0.16 | <0.0001 | 11.2 | 11.5 | 12 | 10.5 | 2143 | 37 | 861 |
| Inventive Steel | 9 | 0.82 | 1.69 | 0.70 | 0.007 | 0.006 | 0.38 | 0.12 | 0.18 | | 0.0022 | 0.2 | 0.15 | <0.0001 | 11.4 | 12.7 | 12 | 10.5 | 2102 | 36 | 865 |
| Inventive Steel | 10 | 0.76 | 1.86 | 0.95 | 0.004 | 0.011 | 0.42 | 0.23 | 0.24 | 0.07 | 0.0024 | 1.5 | 0.01 | <0.0001 | 12.9 | 12.2 | 12 | 11.2 | 2158 | 42 | 854 |
| Inventive Steel | 11 | 0.81 | 1.86 | 0.95 | 0.007 | 0.005 | 0.34 | 0.10 | 0.25 | 0.17 | 0.0053 | 1.2 | 0.09 | <0.0001 | 12.3 | 10.6 | 12 | 9.4 | 2109 | 36 | 855 |
| Inventive Steel | 12 | 0.79 | 1.86 | 0.80 | 0.006 | 0.006 | 0.49 | 0.16 | 0.18 | 0.15 | 0.0025 | 0.1 | 0.15 | <0.0001 | 10.7 | 12.7 | 12 | 11.0 | 2184 | 40 | 887 |
| Comparative | 13 | 0.81 | 1.64 | 0.92 | 0.007 | 0.008 | 1.45 | | 0.46 | 0.21 | 0.0041 | 8.5 | 0.62 | <0.0001 | 10.5 | 11.0 | 13 | 10.8 | 2165 | 16 | 876 |

TABLE 1-continued

| Example | No. | Chemical compositions C | Si | Mn | P | S | Cr | W | V | Mo | N | Area percentage % | Density 0.2–3 | >3 | Maximum diameter of carbide μm | Maximum diameter of oxide μm | Prior austenite grain size number | Retained austenite % | Tensile strength MPa | Bending angle in notch-bending | Fatigue strength in rotating bending fatigue MPa |
|---|---|---|---|---|---|---|---|---|---|---|---|---|---|---|---|---|---|---|---|---|---|
| Steel | | | | | | | | | | | | | | | | | | | | | |
| Comparative Steel | 14 | 0.84 | 1.81 | 0.78 | 0.012 | 0.012 | 1.65 | | 0.29 | 0.16 | 0.0021 | 9.1 | 1.25 | <0.0001 | 11.4 | 11.2 | 11 | 9.7 | 2116 | 17 | 888 |
| Comparative Steel | 15 | 0.82 | 1.99 | 0.81 | 0.005 | 0.003 | 1.52 | | 0.43 | 0.12 | 0.0046 | 2.9 | 1.65 | <0.0001 | 11.2 | 10.1 | 11 | 8.9 | 2137 | 21 | 850 |
| Comparative Steel | 16 | 0.92 | 1.78 | 0.73 | 0.005 | 0.012 | 0.78 | | 0.21 | 0.18 | 0.0051 | 1.9 | 0.02 | 0.003 | 10.6 | 10.1 | 12 | 8.5 | 2138 | 37 | 788 |
| Comparative Steel | 17 | 0.64 | 1.56 | 0.96 | 0.004 | 0.010 | 0.85 | | | 0.14 | 0.0047 | 0.8 | 0.23 | <0.0001 | 11.1 | 12.8 | 11 | 8.4 | 1892 | 31 | 772 |
| Comparative Steel | 18 | 0.91 | 1.79 | 0.50 | 0.006 | 0.007 | 0.91 | | | 0.13 | 0.0055 | 5.7 | 1.35 | <0.0001 | 22.0 | 11.5 | 12 | 7.5 | 2123 | 16 | 871 |
| Comparative Steel | 19 | 0.92 | 1.72 | 0.70 | 0.009 | 0.008 | 0.92 | 0.11 | | | 0.0054 | 1.3 | 0.25 | <0.0001 | 11.9 | 24.0 | 11 | 10.1 | 2101 | 21 | 815 |
| Comparative Steel | 20 | 0.85 | 1.57 | 0.76 | 0.004 | 0.003 | 0.64 | 0.12 | 0.53 | 0.73 | 0.0023 | 2.9 | 0.31 | <0.0001 | 10.0 | 10.2 | 13 | 13.2 | 2209 | 18 | 796 |
| Comparative Steel | 21 | 0.75 | 1.92 | 0.79 | 0.007 | 0.009 | 0.88 | 0.05 | 0.49 | 0.64 | 0.0055 | 6.5 | 0.91 | <0.0001 | 30.0 | 10.4 | 12 | 7.1 | 2176 | 16 | 821 |
| Comparative Steel | 22 | 0.75 | 1.91 | 0.83 | 0.008 | 0.010 | 0.88 | 0.05 | 0.54 | 0.65 | 0.0051 | 5.5 | 1.21 | <0.0001 | 10.4 | 12.2 | 9 | 9.0 | 2200 | 17 | 876 |
| Comparative Steel | 23 | 0.84 | 1.77 | 0.99 | 0.004 | 0.012 | 0.99 | 0.06 | 0.32 | 0.60 | 0.0051 | 9.3 | 0.05 | <0.0001 | 12.7 | 10.8 | 10 | 11.3 | 2158 | 21 | 789 |

The steel wires thus produced were subjected directly to the evaluation of carbides, the tensile strength test and the notch bending test. With regard to the fatigue property evaluation, the test pieces for fatigue test were prepared by: applying the heat treatment at 400° C. for 20 min. to the surfaces of the steel wires, simulating the stress relief annealing in the actual production of springs; after that, applying the shot peening treatment (cut wires 0.6 mm in diameter, for 20 min.); and then applying another stress relief annealing at a low temperature of 180° C. for 20 min.

The evaluation of the size and number of carbides was carried out by specularly polishing the cross section, in the longitudinal direction, of the steel wires directly after being heat-treated, slightly etching the polished surfaces with picric acid, and embossing carbides. Since the measurement of the size of carbides with a means having the accuracy of an optical microscope was difficult, a scanning electron microscope was used and the photographs of the ½ R portions of the steel wires were taken from ten visual fields at random at a magnification of 5,000. The size, the number and the ratio of occupied area of each test piece were measured by binary coding the spheroidal carbides applying an image processing apparatus to the photograph, while confirming that the spheroidal carbides are really the cementite system spheroidal carbides using an x-ray microanalyzer attached to a scanning electron microscope. The whole measured area was 3,088.8 $\mu m^2$.

The amount of retained austenites was obtained by measuring the magnetic flux density of each test piece generated using a direct current magnetization apparatus and converting the magnetic flux density into the amount of retained austenites. For the conversion, a calibration curve, prepared beforehand by specifying the relation between the magnetic flux density and the amount of retained austenites, was used.

As for the tensile property, tensile strength was measured by conducting the test according to JIS (Japanese Industrial Standards) Z 2241 using a test piece of No. 9 defined in JIS Z 2201, and being calculated from the breaking load obtained.

Figure 3A:
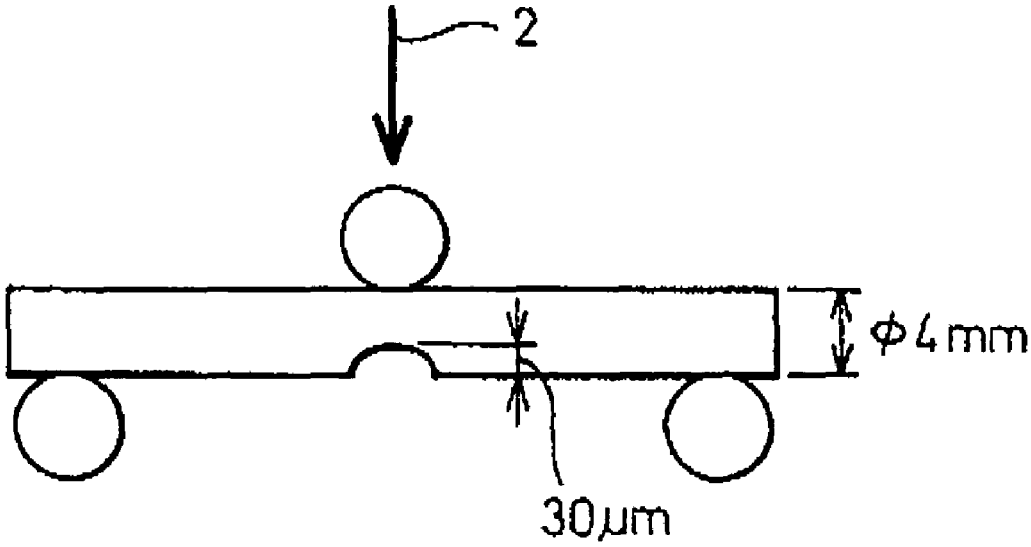
FIG. 3(*a*) is a schematic drawing showing the outline of the notch bending test method before loading.
Figure 3B:
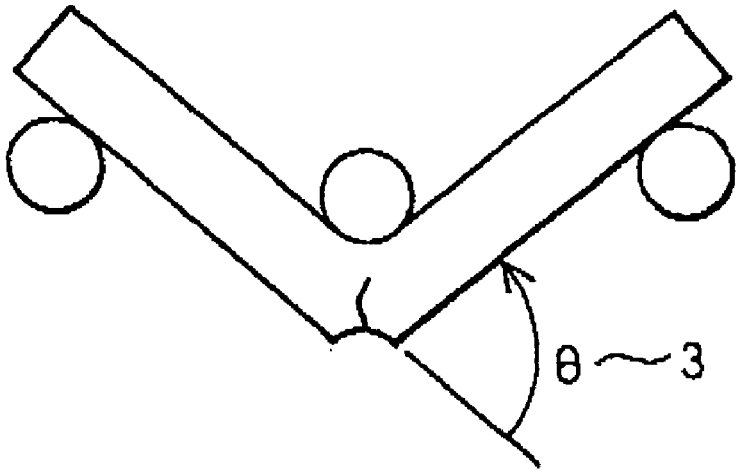

The outline of the notch bending test is shown in (a) and (b) of FIG. 3. The notch bending test was conducted, in order, by: forming a groove (notch) 30 μm in maximum depth perpendicularly to the longitudinal direction of a steel wire with a punch having a tip 50 μm in radius; imposing a bending deformation on the groove at the three points with a load 2 so that the maximum tensile stress was imposed on the groove as shown in FIG. 3(*a*); continuing to impose the bending deformation until the steel wire broke at the notched portion; and measuring the bending angle when the breakage occurred as shown in FIG. 3(*b*). A measured angle 3 is as shown in FIG. 3(*b*). The larger the angle is, the better the coiling property is. Empirically, if a notch bending angle is not more than 25 degree in the case of a steel wire 4 mm in diameter, the steel wire can hardly be coiled.

For the fatigue test, Nakamura's rotating bending fatigue test was employed, and a maximum load stress where 10 test pieces showed the life of not less than $10^7$ cycles at the probability of not less than 50% was determined as an average fatigue strength.

As shown in Table 1, in the case of the steel wires 4 mm in diameter, when the chemical composition of a steel wire is outside the range of the prescription, the control of carbides is hardly implemented, the bending angle in the notch bending test, which acts as the index of the coiling property, becomes small, thus the coiling property deteriorates, and the fatigue strength in the Nakamura's rotating bending fatigue test also deteriorates. Further, even though the chemical compositions of steel wires are within the range of the prescription, in the case of Comparative Examples wherein the maximum diameter of oxides and the grain diameter of prior austenites are outside the range of the prescription according to the present invention, caused by the inappropriate heat treatment conditions, such as the remaining of insoluble carbides caused by the insufficient heating during the stabilizing of carbides in prior annealing or during the quenching, insufficient cooling during the quenching, and the like, the coiling property or the fatigue strength deteriorates. On the other hand, even though the prescription related to carbides is satisfied, when the strength is insufficient, fatigue strength is also insufficient and thus such a steel wire cannot be used for high strength springs.

INDUSTRIAL APPLICABILITY

A steel wire according to the present invention can have a high strength of not less than 2,000 MPa and enables high strength springs excellent in fatigue property to be produced while securing the coiling property by means of reducing the ratio of the area occupied by spheroidal carbides including cementites, the density of the spheroidal carbides, the austenite grain size, and the amount of retained austenites in the steel wire for cold-coiling springs.

The invention claimed is:

1. A heat treated steel wire provided for at least one high strength spring, characterized by: comprising, in mass, C: 0.75% to 0.85%,
Si: 1.5% to 2.5%,
Mn: 0.5% to 1.0%,
Cr: 0.3% to 1.0%,
P: not more than 0.015%,
S: not more than 0.015%,
N: 0.001% to 0.007%,
W: 0.05% to 0.3%, and the balance consisting of Fe and unavoidable impurities, wherein a tensile strength of the steel wire is at least 2,000 MPa, wherein spheroidal carbides of the steel wire are composed of mainly cementite observed in a microscopic visual field, the cementite satisfying the area percentage of the spheroidal carbides of at least 0.2 μm in a circle equivalent diameter being not more than 7%, the density of the spheroidal carbides 0.2 μm to 3 μm in circle equivalent diameter being at most 1 piece/me, a density of the spheroidal carbides being over 3 μm in circle equivalent diameter being not more than 0.001 piece/me, wherein a prior austenite grain size number of the steel wire is at least #10, wherein the content of a retained austenite of the steel wire is at most 12 mass %, wherein a maximum diameter of the spheroidal carbides is at most 15 μm, and wherein a maximum diameter of oxides of the steel wire at most 15 μm.

2. The heat treated steel wire according to claim 1, further characterized by: comprising, in mass, one or two of:

Mo: 0.05% to 0.2% and
V: 0.05% to 0.2%.

* * * * *